United States Patent [19]

Fricke

[11] 4,359,933

[45] Nov. 23, 1982

[54] SLIDING PISTON JOINT OF A HYDROSTATIC PISTON MACHINE

[75] Inventor: Hans-Jürgen Fricke, Stuttgart, Fed. Rep. of Germany

[73] Assignee: Robert Bosch GmbH, Stuttgart, Fed. Rep. of Germany

[21] Appl. No.: 217,996

[22] Filed: Dec. 18, 1980

Related U.S. Application Data

[63] Continuation of Ser. No. 915,064, Jun. 12, 1978, abandoned.

[30] Foreign Application Priority Data

Jul. 17, 1977 [DE] Fed. Rep. of Germany ..... 2731967

[51] Int. Cl.[3] ..... F01B 13/00

[52] U.S. Cl. ..... 92/181 R; 92/158; 91/488

[58] Field of Search ..... 92/181 R, 172, 157, 92/159, 156, 158; 91/488, 499; 308/3 C

[56] References Cited

U.S. PATENT DOCUMENTS

| | | | |
|---|---|---|---|
| 1,487,965 | 3/1924 | Michell | 91/488 X |
| 1,694,938 | 12/1928 | Harris | 308/3 C |
| 1,842,322 | 1/1932 | Hulsebos | 308/3 C |
| 2,290,764 | 7/1942 | Neuland | 92/157 X |
| 2,980,077 | 4/1961 | Magill | 91/488 X |
| 3,188,973 | 6/1965 | Firth et al. | 91/488 X |
| 3,361,077 | 1/1968 | Freeman | 91/499 X |
| 4,018,137 | 4/1977 | Fricke et al. | 91/488 |

*Primary Examiner*—George L. Walton
*Attorney, Agent, or Firm*—Michael J. Striker

[57] ABSTRACT

A sliding piston joint of a hydrostatic piston machine has a piston having a recess or cavity and a sliding shoe having a head portion receivable into the recess or cavity of the piston so as to support the latter. The sliding shoe has a base portion having a surface which faces away from the piston and faces toward a hydrostatic pressure zone generated during operation of the machine. The head portion of the sliding shoe and the piston have surfaces which are in sliding contact with one another. A throughgoing passage extends through the sliding shoe so that a portion of working fluid flows from the hydrodynamic pressure zone to the contacting surfaces of the sliding shoe and the piston to thereby relieve the latter.

12 Claims, 4 Drawing Figures

SLIDING PISTON JOINT OF A HYDROSTATIC PISTON MACHINE

CROSS-REFERENCE TO A RELATED APPLICATION

This application is a Rule 60 continuation of the application Ser. No. 915,064 filed June 12, 1978 and now abandoned.

BACKGROUND OF THE INVENTION

The present invention relates to a sliding piston joint of hydrostatic piston machines.

A sliding piston joint of a hydrostatic machine has been proposed, in which a hydrostatic pressure field is developed at a base portion of the sliding shoe and communicates with a recess or cavity of a piston through a passage which is formed in the sliding shoe and in a head portion of the piston. Such a joint is disclosed in the U.S. Pat. No. 4,018,137. In this case a small quantity of pressure fluid is supplied from a high pressure side of the hydrostatic piston machine into the hydrostatic pressure field so as to hydrostatically relieve the sliding shoe. This has a disadvantage that a certain quantity of pressure medium is always being lost, and that a hydrostatic pressure field must be developed at the sliding shoe. Furthermore, the communication of the cavity with the piston receiving passage results in that during the suction stroke insufficient quantity of pressure fluid is supplied for relief of the piston.

SUMMARY OF THE INVENTION

Accordingly, it is an object of the present invention to provide a sliding piston joint of a hydrostatic piston machine, which avoids the disadvantages of the prior art.

More particularly, it is an object of the present invention to provide a sliding piston joint of a hydrostatic piston machine, in which no hydrostatic pressure field has to be developed at the sliding shoe of the sliding piston joint and, at the same time, pressure fluid flows into the cavity during the suction stroke, and provides for hydrostatic relief or support of the cavity during the pressure stroke of the machine.

In keeping with these objects, and with others which will become apparent hereinafter, one feature of the present invention resides, briefly stated, in a sliding piston joint of a hydrostatic piston machine, which comprises a piston having a recess, a sliding shoe having a head portion receivable into the recess or cavity so as to support the piston, and a base portion having a surface which faces away from the piston and faces toward the hydrodynamic pressure zone generated during operation of the machine and means for hydrostatically relieving the sliding shoe of the piston joint, which means includes only a throughgoing passage extending through the sliding shoe so that a portion of working fluid flows from the hydrodynamic pressure zone to the contacting surfaces to thereby lubricate the latter.

The head portion of the sliding shoe may have a shape of spherical segment, and the recess or cavity of the piston may have a portion which is shaped complementary to the shape of the head portion of the sliding shoe. The throughgoing passage of the sliding shoe is open at the surface of the base portion of the sliding shoe which faces toward the hydrodynamic pressure zone, and thereby this passage is open into the hydrodynamic pressure zone.

Another feature of the present invention is that the throughgoing passage of the sliding shoe is open into a region of the hydrodynamic pressure zone, in which the highest pressure is developed.

Still another feature of the present invention is that a variable gap is provided between the head portion of the sliding shoe and the wall section of the piston in the region located between the cavity formed between the head portion and the piston, on the one hand, and an open end of the piston, on the other hand.

In accordance with a further feature of the present invention a hollow is formed between an upper section of the head portion of the sliding shoe and the piston, and the throughgoing passage of the sliding shoe communicates with the cavity.

A still further feature of the present invention is that the throughgoing passage of the sliding shoe has throttling means, which means may be formed as a constriction of this passage.

An additional feature of the present invention is that a groove may be provided on the surface of the base portion of the sliding shoe and in the region at which the throughgoing passage is open.

A still additional feature of the present invention is that this groove is shallow and has a small depth.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
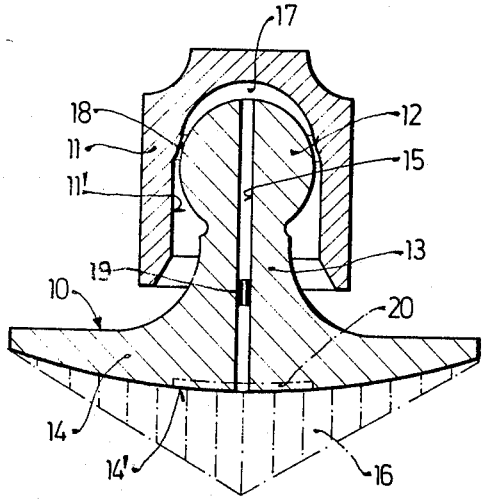
FIG. 1 is a view showing a section of a piston and a sliding shoe received therein in accordance with one embodiment of the present invention.
Figure 1A:
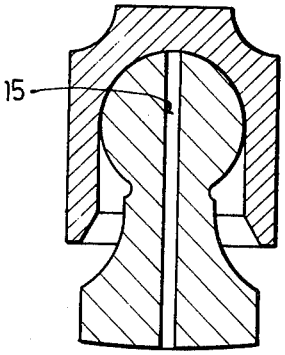
FIG. 1*a* is a view showing a section of the piston and the sliding shoe received therein in accordance with another embodiment of the present invention.

FIG. 1 shows a sliding piston joint of a hydrostatic piston machine. The sliding piston joint has a sliding shoe identified by reference numeral 10 and a piston identified by reference numeral 11. The sliding shoe 10 has a head portion 12 which is received in a recess or cavity of the piston 11 so as to support the latter. The head portion 12 of the sliding shoe 10 has a shape of a spherical segment and is connected with a base portion 14 of the sliding shoe 10 by an intermediate portion 13. The portions 12, 13 and 14 together form an integral member. No hydrostatic field is developed is a sliding face 14', inasmuch as the latter does not have recesses or grooves and is generally smooth.

A throughgoing passage 15 extends through the sliding shoe 10. It extends from an upper section of the head portion 12 of the sliding shoe 10 and is open at the base portion 14 of the latter. As shown in FIG. 1, a hydrodynamic pressure field 16 is developed in the region of the sliding face 14' of the base portion 14 of the sliding shoe 10. The throughgoing passage 15 is open at the sliding surface 14' and therefore is also open into the hydrodynamic pressure field 16. The hydrodynamic pressure field 16 has a region in which the pressure has its greatest magnitude or in which pressure peak is developed. The throughgoing passage 15 is opened into the hydrodynamic pressure field 16 in the above-mentioned region of the latter wherein the greatest pressure is developed.

As can be seen from FIG. 1, a cavity 17 is formed between the upper section of the head portion 12 of the sliding shoe 10 and an inner wall 11' which bounds the inner recess of the piston 11. The cavity is identified by reference numeral 17 and has a shape of a segment. In operation, a hydrostatic pressure is built in the cavity 17 on the head portion 12 of the sliding shoe 10 from the hydrodynamic pressure field 16. A variable throttling gap 18 is formed between the cavity 17 and a lower part of the piston lengthwise of the head portion 12 of the sliding shoe 10. In this case, throttling means is provided in the throughgoing passage 15, which throttling means is identified by reference numeral 19 and may be formed by a local constriction of the throughgoing passage 15. This forms a constant control valve. The pressure in the cavity 17 is thereby smaller than the hydraulic pressure in the hydrodynamic pressure field 16. The pressure peak of the hydrodynamic pressure field 16 can be considerably higher than the pressure in the receiving recess of the piston. The piston portion 14 of the sliding shoe 10 may be correspondingly constructed therefor, particularly its curvature and so on.

In accordance with another embodiment of the present invention, no hollow is provided between the head portion 12 of the sliding shoe 10 and the wall portion of the inner recess of the piston 11. In other words, the inner wall portion which bounds the inner recess of the piston 11 directly abuts against the head portion 12 of the sliding shoe 10. The pressure fluid is supplied into the gap between the head portion 12 and the inner wall of the piston 11 through a throughgoing passage 15. A sliding face of the sliding shoe 14 is identified in this embodiment by reference numeral 14".

Figure 2:
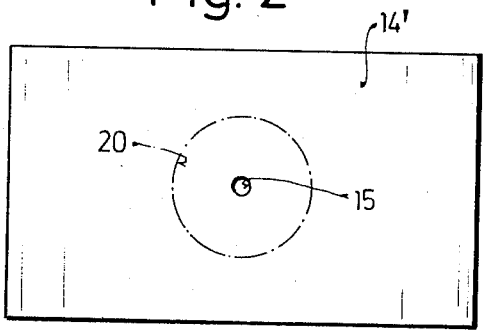
FIG. 2 is a view showing a base portion of the sliding shoe for a radial piston machine.
Figure 3:
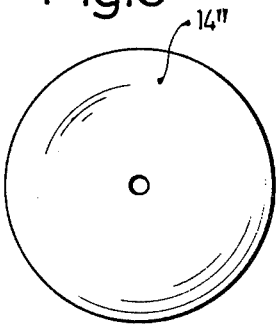
FIG. 3 is a view showing the base portion of the sliding shoe for an axial piston machine.

A groove or indentation 20 may be provided in the sliding face of the base portion 14 of the sliding shoe 10, and particularly in the region of the sliding face at which the throughgoing passage 15 is open. This groove is shown in dotted lines in FIGS. 1 and 2. The groove 20 is shallow and has a small depth. A pressure is present in the groove, that results from the hydrodynamic pressure built up at the supporting surface which limits the field.

When the sliding piston joint is constructed in accordance with the present invention, the pressure fluid flows into the cavity during the suction stroke and provides for hydrostatic relief or support of the head portion of the sliding shoe during the pressure stroke of the hydrostatic piston machine.

It will be understood that each of the elements described above, or two or more together, may also find a useful application in other types of constructions differing from the types described above.

While the invention has been illustrated and described as embodied in a sliding piston joint of a hydrostatic piston machine, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sliding piston joint of a hydrostatic piston machine, comprising a piston having an inner wall section bounding a recess with a closed end and an open end; a sliding shoe having a head portion with a first surface receivable into said recess of said piston and together with said inner wall section of said piston forming a closed cavity at said closed end of said recess, said sliding shoe also having a base portion with a second surface which faces away from said piston and faces toward a hydrodynamic pressure zone generated during operation of the machine at said second surface of said base position, said head portion of said sliding shoe and said piston being in sliding contact with one another; and means for hydrostatically relieving said head portion of said sliding shoe which includes a throughgoing passage extending through said sliding shoe from said base portion to said head portion of said sliding shoe and being open at said surfaces and into said closed cavity at said closed end of said piston, and a variable sealing means formed between the head portion and the inner wall section, so that a portion of working fluid flows through said throughgoing passage from said hydrodynamic pressure zone at said base portion to and outwardly of said head portion of said sliding shoe and into said closed cavity at said closed end of said piston and via said variable sealing means to said open end of said piston to thereby hydrostatically relieve said head portion of said sliding shoe.

2. The sliding piston joint as defined in claim 1, wherein said head portion of said sliding shoe has a shape of a spherical segment.

3. The sliding piston as defined in claim 1, wherein at least a portion of said recess has a shape which is complementary to said shape of said head portion of said sliding shoe.

4. The sliding piston joint as defined in claim 1, wherein said closed cavity has the shape of a segment.

5. The sliding piston joint as defined in claim 1, wherein said hydrodynamic pressure zone includes the region of the highest pressure, said throughgoing passage being open into said region of said zone.

6. The sliding piston joint as defined in claim 1; and further comprising throttling means provided in said throughgoing passage.

7. A sliding piston joint as defined in claim 6, wherein said sliding shoe has an inner wall section which bounds said throughgoing passage and forms said throttling means.

8. A sliding piston joint as defined in claim 7, wherein said inner wall section of said sliding shoe is elongated, said throttling means being formed in one region of a length of said inner wall section.

9. The sliding piston joint as defined in claim 7, wherein said throttling means is formed as a constriction of said throughgoing passage in said one region.

10. The sliding piston joint as defined in claim 1; and further comprising a groove formed in said surface of said base portion of said sliding shoe and in the region wherein said throughgoing passage is open at said surface.

11. The sliding piston joint as defined in claim 10, wherein said groove is shallow and has a substantially small depth.

12. A sliding piston joint of a hydrostatic piston machine, comprising a piston having an inner wall section bounding a recess with a closed end and an open end; a sliding shoe having a head portion with a first surface receivable into said recess of said piston and together with said inner wall section of said piston forming a closed cavity at said closed end of said recess, said head portion of said sliding shoe together with said inner wall section of said piston forming a variable sealing gap located between said cavity and said open end of said piston, said sliding shoe also having a base portion with a second surface which faces away from said piston and faces toward a hydrodynamic pressure zone generated during operation of the machine, said head portion of said sliding shoe and said piston being in sliding contact with one another; and means for hydrostatically relieving said head portion of said sliding shoe and including only a throughgoing passage extending through said sliding shoe from said base portion to said head portion of said sliding shoe and being open at said surfaces and into said closed cavity at said closed end of said piston, so that a portion of working fluid flows from said hydrodynamic pressure zone at said base portion to and outwardly of said head portion of said sliding shoe and into said cavity at said closed end of said piston and via said variable sealing gap to said open end of said piston to thereby hydrostatically relieve said head portion of said sliding shoe.

* * * * *